US005445930A

United States Patent [19]

Harada et al.

[11] Patent Number: 5,445,930

[45] Date of Patent: Aug. 29, 1995

[54] SILVER HALIDE PHOTOGRAPHIC MATERIAL

[75] Inventors: Toru Harada; Itsuo Fujiwara, both of Kanagawa, Japan

[73] Assignee: Fuji Photo Film Co., Ltd., Kanagawa, Japan

[21] Appl. No.: 329,672

[22] Filed: Oct. 25, 1994

Related U.S. Application Data

[63] Continuation of Ser. No. 93,616, Jul. 20, 1993, abandoned.

[30] Foreign Application Priority Data

Jul. 22, 1992 [JP] Japan ..... 4-215702

[51] Int. Cl.[6] ..... G03C 1/12

[52] U.S. Cl. ..... 430/588; 430/513; 430/522; 430/583; 430/584; 430/585; 430/586; 430/587; 430/944

[58] Field of Search ..... 430/588, 513, 522, 583, 430/584, 585, 586, 587

[56] References Cited

U.S. PATENT DOCUMENTS

| | | | |
|---|---|---|---|
| 3,460,947 | 8/1969 | Ficken . | |
| 3,482,978 | 12/1969 | Fumia et al. | 430/588 |
| 4,876,181 | 10/1989 | Proehl et al. . | |
| 4,882,265 | 11/1989 | Laganis et al. | 430/522 |
| 4,933,269 | 6/1990 | Parton et al. | 430/522 |
| 5,107,063 | 4/1992 | West et al. | 548/455 |
| 5,190,854 | 3/1993 | Goedeweeck | 430/576 |
| 5,330,884 | 7/1994 | Fabricius et al. | 430/522 |

FOREIGN PATENT DOCUMENTS

| | | |
|---|---|---|
| 0362387 | 4/1990 | European Pat. Off. . |
| 0430244 | 6/1991 | European Pat. Off. . |
| 908750 | 11/1944 | France . |

OTHER PUBLICATIONS

Synthetic Communications, Strekowski et al., Facile Derivatizations of Heptamethine Cyanine Dyes, 1992, 2593–2598.

J. Org. Chem., Strekowski et al., Substitution Reactions of a Nucleofugal Group in Heptamethine Cyanine Dyes. Synthesis of an Isothiocyanate Derivative for Labeling of Proteins with a Near-Infrared Chromophore, 1992, 4578–4580.

*Primary Examiner*—Thorl Chea

*Attorney, Agent, or Firm*—Sughrue, Mion, Zinn, Macpeak & Seas

[57] ABSTRACT

A novel silver halide photographic material is provided, comprising a hydrophilic colloidal layer containing at least one dye represented by the following formula (I):

(I)

wherein $Y^1$ and $Y^2$ each represents a chalcogen atom, —CH=CH—, —N($R^{10}$)—, or —C ($R^{10}$)($R^{11}$)—, in which $R^{10}$ and $R^{11}$ each represents an alkyl group; $Z^1$ and $Z^2$ each represents a nonmetallic atom group necessary for forming a benzo condensed or naphtho condensed ring; $R^1$ and $R^2$ each represents an alkyl group; the plurality of L groups may be the same or different and each represents a methine group, with the proviso that at least one of the plurality of L groups represents a methine group substituted by —$OR^{12}$, —N($R^{12}$)($R^{13}$), —$SR^{12}$ or —CH($R^{14}$)($R^{15}$), in which $R^{12}$ represents an alkyl or aryl group substituted by an acidic substituent, $R^{13}$ represents a hydrogen atom or an alkyl or aryl group substituted by an acidic substituent, and $R^{14}$ and $R^{15}$ each represents a cyano group, a carboxylic acid group, an acyl group, an alkoxycarbonyl group, an aryloxycarbonyl group, a carbamoyl group, a sulfonyl group or a sulfamoyl group, with the proviso that at least one of $R^{14}$ and $R^{15}$ contains an acidic substituent; X represents an anion; p represents an integer 0 or 1; r represents an integer 0 or 1; m represents an integer 2 or 3; and n represents an integer 1 or 2, with the proviso that when the dye forms an intramolecular salt, n is 1; and wherein the dye contains at least three acidic substituents.

3 Claims, No Drawings

SILVER HALIDE PHOTOGRAPHIC MATERIAL

This is a Continuation of application Ser. No. 08/093,616 filed Jul. 20, 1993, now abandoned.

FIELD OF THE INVENTION

The present invention relates to a silver halide photographic material comprising a dyed hydrophilic colloidal layer. More particularly, the present invention relates to a silver halide photographic material comprising a hydrophilic colloidal layer containing a dye which exhibits absorption in the infrared region, is stable in photographic light-sensitive materials, exhibits a photochemical inertness and can easily be decolored in a photographic processing procedure.

BACKGROUND OF THE INVENTION

With silver halide photographic materials, it is a frequent practice to color the photographic emulsion layer or other layers for the purpose of absorbing light in a specific wavelength.

When it is necessary to control the spectral composition of the light incident upon the photographic emulsion layer, a colored layer is provided on the side of the photographic emulsion layer on the photographic light-sensitive layer far from the support. Such a colored layer is called a filter layer. If a plurality of photographic emulsion layers are provided, as in a multi-layer color photographic light-sensitive material, such a filter layer may be provided between these photographic emulsion layers.

For the purpose of inhibiting blur in the image caused by the reflection of light which has been scattered during or after the transmission through the photographic emulsion layer by the interface of the emulsion layer with the support or the surface of the photographic light-sensitive material opposite the emulsion layer and the subsequent re-entry of the light into the photographic emulsion layer, i.e., halation, a colored layer may be provided between the photographic emulsion layer and the support or the side of the support opposite the photographic emulsion layer. Such a colored layer is called an antihalation layer. In the case of a multi-layer color photographic light-sensitive material, such an antihalation layer may be provided between the various layers.

In order to inhibit the drop of image sharpness due to the scattering of light in the photographic emulsion layer (generally referred to as "irradiation"), the photographic emulsion layer may be colored.

Most of these layers to be colored comprise hydrophilic colloid. Therefore, these layers normally comprise a water-soluble dye incorporated therein in order to provide color. Such a dye needs to meet the following requirements:

(1) to exhibit an appropriate spectral absorption depending on the purpose;

(2) to be photochemically inert (i.e., to give no chemically adverse effects on the properties of the silver halide photographic material such as sensitivity drop, latent image regression and photographic fog);

(3) to be insusceptible to decoloration or removal by dissolution in the photographic processing procedure which leaves a harmful color on the processed photographic light-sensitive material; and (4) to exhibit excellent stability over time in a solution or photographic light-sensitive material.

As dyes meeting these requirements, many dyes which absorb visible light or ultraviolet rays are known. These dyes are suitable for the purpose of improving image quality in a conventional photographic element which has been sensitized to a wavelength range of 700 nm or less. In particular, triarylmethane and oxonol dyes are widely used in this connection.

On the other hand, it has recently been desired to develop an antihalation and anti-irradiation dye which exhibits absorption in the infrared region for use in a photographic light-sensitive material which serves as a recording material sensitized to the infrared region such as a recording material for recording the output of a near infrared laser.

One of the known methods for the exposure of such a photographic light-sensitive material is an image formation method by a so-called scanner process which comprises scanning an original image to provide an image signal according to which a silver halide photographic material is exposed to form a negative or positive image corresponding to the original image. In this method, the scanner process recording light source most preferably used is a semiconductor laser. The semiconductor laser is a small-sized and inexpensive laser that can be easily modulated. The semiconductor laser is also long-lived and emitts light in the infrared region as compared with a He-Ne laser and an argon laser. Therefore, when a photographic light-sensitive material sensitive to the infrared region is used, a brighter safelight can be used, which advantageously improves the handleability of the material.

However, since there are no appropriate dyes which exhibit absorption in the infrared region and meet the foregoing requirements (1), (2), (3) and (4), especially (3) and (4), it is difficult to obtain an excellent photographic light-sensitive material which is highly sensitive to the infrared region and insusceptible to halation and irradiation. Thus, the properties of the excellent semiconductor laser cannot be made the best use of.

Many efforts have heretofore been made to find a dye that meets the foregoing requirements. Many dyes have been proposed.

For example, tricarbocyanine dyes are disclosed in JP-A-62-123454, JP-A-63-55544, JP-A-64-33547, and JP-A-3-171136 (The term "JP-A" as used herein means an "unexamined published Japanese patent application"), oxonol dyes are disclosed in JP-A-1-227148, melocyanine dyes are disclosed in JP-A-1-234844, tetraryl type polymethine dyes are disclosed in JP-A-2-216140, and indoaniline dyes are disclosed in JP-A-50-100116, JP-A-62-3250, and JP-A-2-259753.

Nevertheless, it is difficult to find a dye that meets all the foregoing requirements.

SUMMARY OF THE INVENTION

It is therefore an object of the present invention to provide a dye that meets the foregoing requirements (1), (2), (3) and (4), and particularly to provide an infrared-sensitive silver halide photographic material which remains stable during storage and leaves little color after development.

This and other objects of the present invention will become more apparent from the following detailed description and examples.

The objects of the present invention are accomplished with a silver halide photographic material, comprising a support having thereon a hydrophilic colloidal layer containing at least one dye represented by the following formula (I):

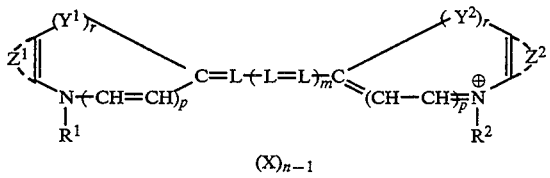

(I)

wherein $Y^1$ and $Y^2$ each represents a chalcogen atom, —CH=CH—, —N($R^{10}$)—, or —C($R^{10}$)($R^{11}$)—; in which $R^{10}$ and $R^{11}$ each represents an alkyl group;

$Z^1$ and $Z^2$ each represents a nonmetallic atom group necessary for forming a benzo condensed or naphtho condensed ring;

$R^1$ and $R^2$ each represents an alkyl group;

the plurality of L groups may be the same or different and each represents a methine group, with the proviso that at least one of the plurality of L groups represents a methine group substituted by —$OR^{12}$, —N($R^{12}$)($R^{13}$), —$SR^{12}$, or —CH($R^{14}$)($R^{15}$); in which $R^{12}$ represents an alkyl or aryl group substituted by an acidic substituent, $R^{13}$ represents a hydrogen atom or an alkyl or aryl group substituted by an acidic substituent, and $R^{14}$ and $R^{15}$ each represents a cyano group, a carboxylic acid group, an acyl group, an alkoxycarbonyl group, an aryloxycarbonyl group, a carbamoyl group, a sulfonyl group or a sulfamoyl group, with the proviso that at least one of $R^{14}$ and $R^{15}$ contains an acidic substituent;

X represents an anion;

p represents an integer 0 or 1;

r represents an integer 0 or 1;

m represents an integer 2 or 3; and n represents an integer 1 or 2, with the proviso that when the dye forms an intramolecular salt, n is 1;

and wherein the dye contains at least three acidic substituents.

DETAILED DESCRIPTION OF THE INVENTION

Formula (I) will be further described hereinafter. Examples of the chalcogen atom represented by $Y^1$ or $Y^2$ include oxygen, sulfur, selenium, and tellurium. $R^{10}$ and $R^{11}$ may be the same or different and each represents a substituted or unsubstituted alkyl group, preferably an alkyl group having from 1 to 5 carbon atoms (E.g., methyl, ethyl, n-propyl, n-butyl, n-pentyl) which may contain substituents such as a sulfonic acid group, a carboxylic acid group and a hydroxyl group.

$R^1$ and $R^2$ have the same meaning as the alkyl group as defined above for $R^{10}$, preferably an alkyl group having from 1 to 5 carbon atoms substituted by a sulfonic acid or carboxylic acid group (e.g., 3-sulfopropyl, 4-sulfobutyl, 2-carboxyethyl).

The term "acidic substituent" as used herein means a "sulfonic acid group, carboxylic acid group or phosphonic acid group". The term "sulfonic acid group" as used herein means a "sulfo group or salt thereof". The term "carboxylic acid group" as used herein means a "carboxyl group or salt thereof". The term "phosphonic acid group" as used herein means a "phosphono group or salt thereof". Examples of these salts include salts of alkaline metal such as sodium and potassium, and organic ammonium salts such as ammonium salt, triethylammonium salt, tributylammonium salt, pyridinium salt, and tetrabutylammonium salt.

The benzo condensed or naphtho condensed ring formed by nonmetallic atom groups represented by $Z^1$ and $Z^2$ may be substituted by a halogen atom (e.g., Cl, F, Br), a substituted amino group (e.g., dimethylamino, diethylamino, di(4-sulfobutyl)amino, di(2-carboxyethyl-)amino), a hydroxyl group, a sulfonic acid group, a carboxylic acid group or a substituted or unsubstituted alkyl group having from 1 to 5 carbon atoms (e.g., methyl, ethyl, propyl (substituents are preferably a sulfonic acid group, a carboxylic acid group and a hydroxyl group)) which is connected to the ring directly or a divalent connecting group. Preferred examples of the divalent connecting group include —O—, —NHCO—, —$NHSO_2$—, —$NHCO_2$—, —NHCONH—, —COO—, —CO—, and —$SO_2$—. More preferably, the benzo condensed or naphtho condensed ring is substituted by a sulfonic acid or carboxylic acid group.

The alkyl group represented by $R^{12}$ as a substituent on the L groups represents an alkyl group having from 1 to 5 carbon atoms substituted by a sulfonic acid or carboxylic acid group (e.g., carboxymethyl, 2-carboxyethyl, 2-sulfoethyl, 3-sulfopropyl, 4-sulfobutyl). The aryl group represented by $R^{12}$ is preferably a phenyl or naphthyl group which may be substituted by a sulfonic acid or carboxylic acid group, and which may be further substituted by an alkyl group (as defined above), a halogen atom (F, Cl, Br), a hydroxyl group or an amino group (which have the same meaning as the foregoing substituted amino group or may be substituted by an alkylcarbonyl or arylcarbonyl group as defined lager).

The alkyl and aryl groups represented by $R^{13}$ as substituents on the L groups have the same meaning as those defined with reference to $R^{12}$.

The acyl group represented by $R^{14}$ or $R^{15}$ as a substituent on the L groups contains the alkyl group defined with reference to $R^{10}$ or the aryl group defined with reference to $R^{12}$.

The alkyl moiety in the alkoxycarbonyl group represented by $R^{14}$ or $R^{15}$ as a substituent on the L groups has the same meaning as the alkyl group represented by $R^{10}$. The aryl moiety in the aryloxycarbonyl group represented by $R^{14}$ or $R^{15}$ has the same meaning as the aryl group represented by $R^{12}$.

The carbamoyl group, sulfonyl group or sulfamoyl group represented by $R^{14}$ or $R^{15}$ on the L groups may be substituted by the alkyl group as defined with reference to $R^{10}$ or the aryl group as defined with reference to $R^{12}$.

At least one of $R^{14}$ and $R^{15}$ is substituted by an acidic substituent. Further, at least three acidic substituents are contained in the dye.

Examples of anion represented by X include a halogen ion (e.g., $Cl^-$, $Br^-$, $I^-$), a p-toluenesulfonic acid ion, an ethylsulfric acid ion, $PF_6^-$, $BF_4^-$, and $ClO_4^-$.

Preferably, the dyes of formula (I) are represented by formula (II) below. Thus, the objects of the present invention are accomplished with a silver halide photographic material, comprising a hydrophilic colloidal layer containing at least one dye represented by the following formula (II):

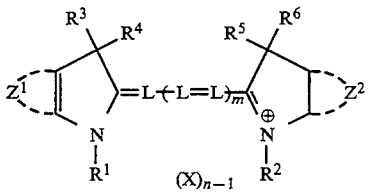

(II)

wherein $Z^1$ and $Z^2$ each represents a nonmetallic atom group necessary for forming a benzo condensed or naphtho condensed ring;

$R^1$, $R^2$, $R^3$, $R^4$, $R^5$ and $R^6$ each represents an alkyl group; the plurality of L groups may be the same or different and each represents a methine group, with the proviso that at least one of the plurality of L groups represents a methine group substituted by $—OR^{12}$, $—N(R^{12})(R^{13})$, $—SR^{12}$, or $—CH(R^{14})(R^{15})$; in which $R^{12}$ represents an alkyl or aryl group substituted by an acidic substituent, $R^{13}$ represents a hydrogen atom or an alkyl or aryl group substituted by an acidic substituent, and $R^{14}$ and $R^{15}$ each represents a cyano group, a carboxylic acid group, an acyl group, an alkoxycarbonyl group, an aryloxycarbonyl group, a carbamoyl group, a sulfonyl group or a sulfamoyl group, with the proviso that at least one of $R^{14}$ and $R^{15}$ contains an acidic substituent;

X represents an anion;

m represents an integer 2 or 3; and n represents an integer 1 or 2, with the proviso that when the dye forms an intramolecular salt, n is 1;

and wherein the dye contains at least four acidic substituents.

The various substituents in formula (II) have the same meaning as that defined in formula (I) . However, the alkyl group represented by $R^3$ to $R^6$ has the same meaning as that defined with reference to $R^{10}$.

Preferably the dyes of formula (II) are represented by formula (III) below. Thus, the objects of the present invention is further accomplished with a silver halide photographic material, comprising a hydrophilic colloidal layer containing at least one dye represented by the following formula (III):

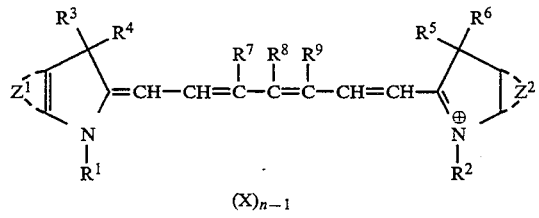

(III)

wherein $Z^1$ and $Z^2$ each represents a nonmetallic atom group necessary for forming a benzo condensed or naphtho condensed ring;

$R^1$, $R^2$, $R^3$, $R^4$, $R^5$ and $R^6$ each represents an alkyl group; $R^7$ and $R^9$ each represents a hydrogen atom or a nonmetallic atom group necessary for forming a 5- or 6-membered ring by connecting to each other;

$R^8$ represents $—OR^{12}$, $—N(R^{12})(R^{13})$, $—SR^{12}$, or $—CH(R^{14})(R^{15})$; in which $R^{12}$ represents an alkyl or aryl group substituted by an acidic substituent, $R^{13}$ represents a hydrogen atom or an alkyl or aryl group substituted by an acidic substituent, and $R^{14}$ and $R^{15}$ each represents a cyano group, a carboxylic acid group, an acyl group, an alkoxycarbonyl group, an aryloxycarbonyl group, a carbamoyl group, a sulfonyl group or a sulfamoyl group, with the proviso that at least one of $R^{14}$ and $R^{15}$ contains an acidic substituent;

X represents an anion; and n represents an integer 1 or 2, with the proviso that when the dye forms an intramolecular salt, n is 1;

and wherein the dye contains at least four acidic substituents.

The substituents in formula (III) have the same meaning as those defined in formula (II).

Moreover, the objects of the present invention are accomplished with a silver halide photographic material as defined above, wherein $R^8$ in formula (III) is $—SR^{16}$, in which $R^{16}$ represents an alkyl or aryl group substituted by a sulfonic acid or carboxylic acid group, and $R^7$ and $R^9$ are connected to each other to form a 5- or 6-membered ring.

The alkyl group and aryl group represented by $R^{16}$ have the same meaning as that defined with reference to $R^{12}$.

Specific examples of the compound of the present invention are shown below, but the present invention should not be construed as being limited thereto:

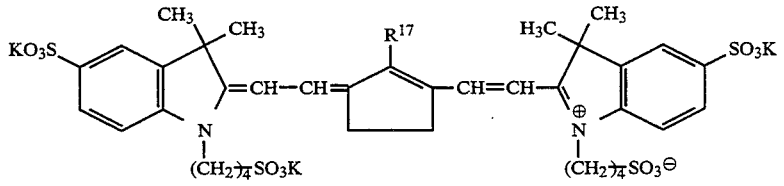

| Compound No. | $R^{17}$ |
|---|---|
| (1) | $—SCH_2CO_2K$ |
| (2) | 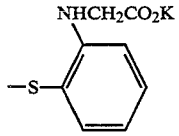 |

-continued
(3)
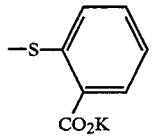
(4) $-SCH_2CH_2CO_2K$
(5) $-SCH_2CH_2SO_3K$
(6) $-SCH(CH_2CO_2K)-CO_2K$
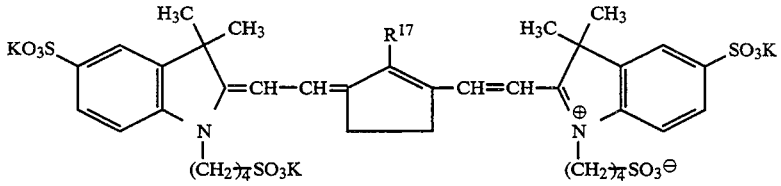
| Compound No. | $R^{17}$ |
|---|---|
| (7) | 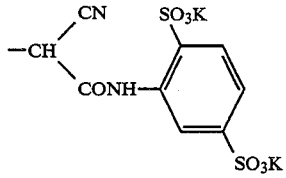 |
| (8) | $-CH(CO_2K)_2$ |
| (9) | 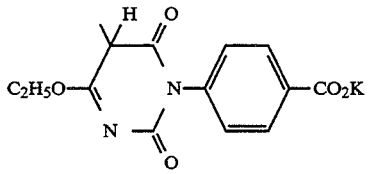 |
| (10) | 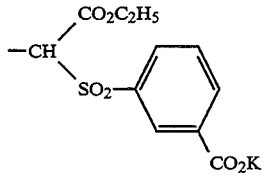 |
| (11) | 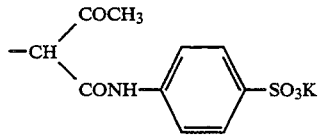 |
| (12) | 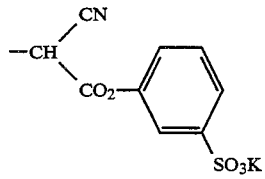 |
| (13) | 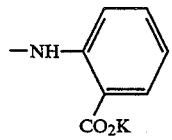 |

-continued
(14)
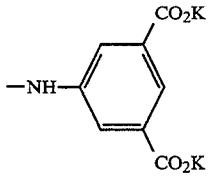
(15)
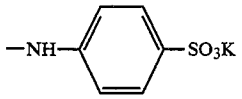
(16)
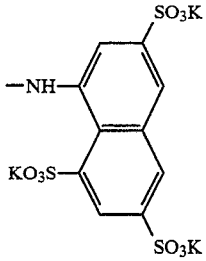
(17) $-NHCH_2CH_2SO_3K$
(18)
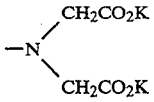
(19) $-OCH_2CH_2SO_3K$
(20)
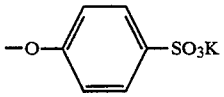
(21)
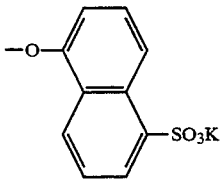
(22)
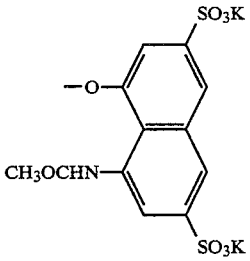
(23) $-O-CH_2CO_2K$
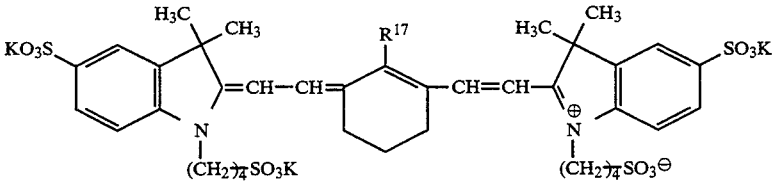
| Compound No. | $R^{17}$ |
|---|---|
| (24) | $-SCH_2CO_2K$ |

-continued
(25)
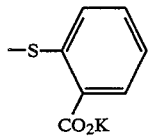
(26)
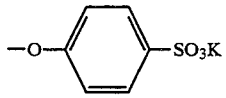
(27)
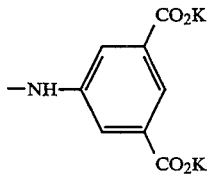
(28)
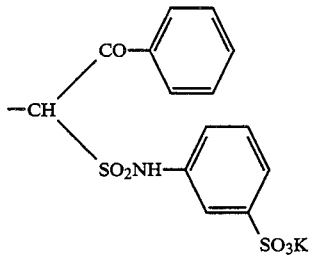
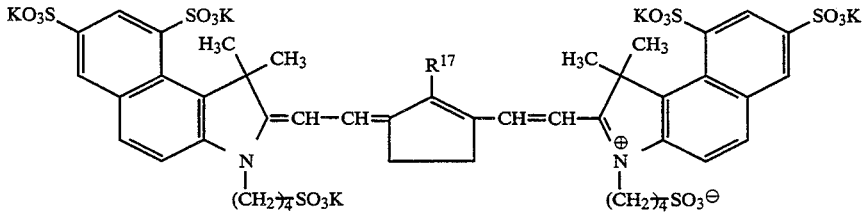
| Compound No. | $R^{17}$ |
|---|---|
| (29) | $-SCH_2CO_2K$ |
| (30) | 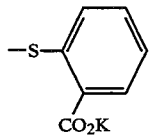 |
| (31) | 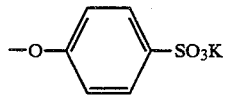 |
| (32) | 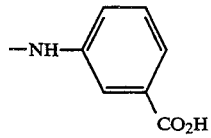 |
| (33) | $-CH(CO_2K)_2$ |
| (34) | $-SCH(CH_2CO_2K)-CO_2K$ |

-continued
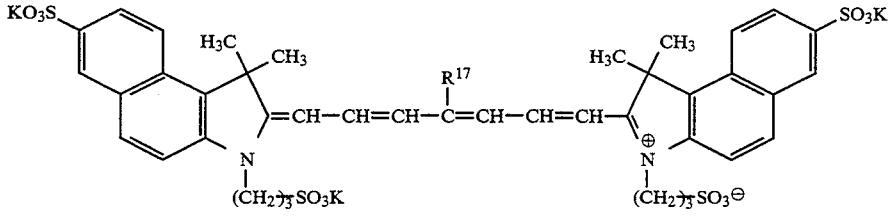
| Compound No. | $R^{17}$ |
|---|---|
| (35) | $-SCH_2CO_2K$ |
| (36) | 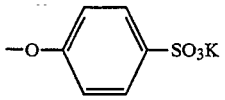 |
| (37) | $-NHCH_2CO_2K$ |
| (38) | 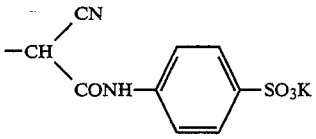 |
| (39) | $-SCH_2CH_2CO_2K$ |
Compound (40)
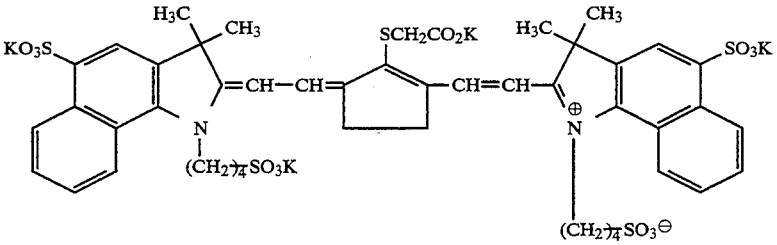
Compound (41)
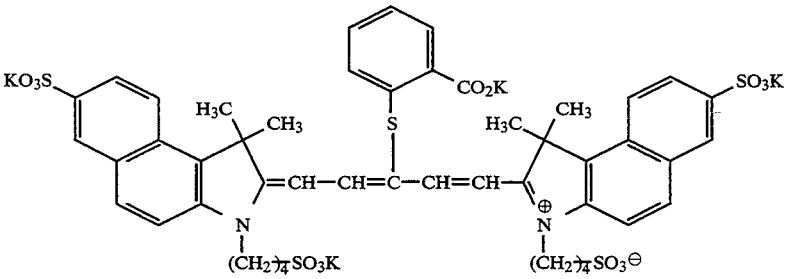
Compound (42)
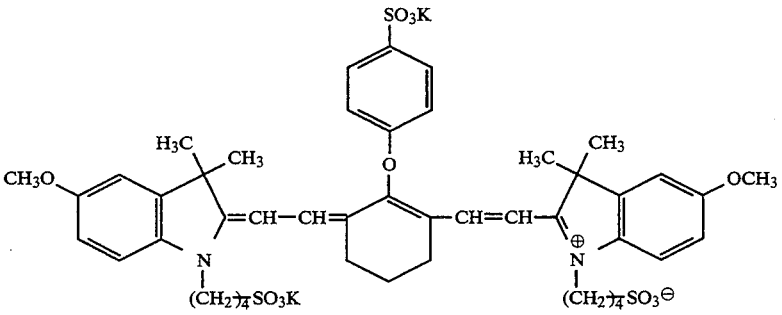
Compound (43)

-continued
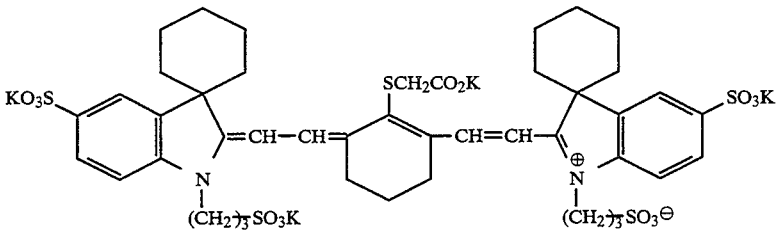
Compound (44)
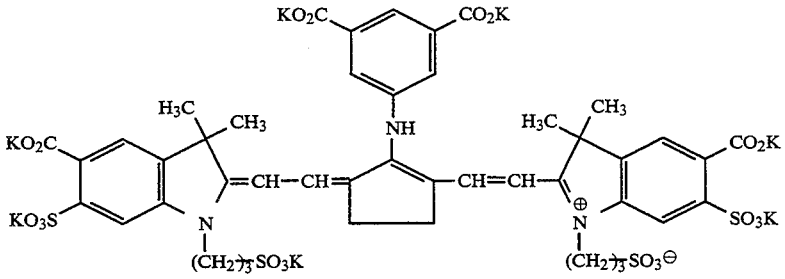
Compound (45)
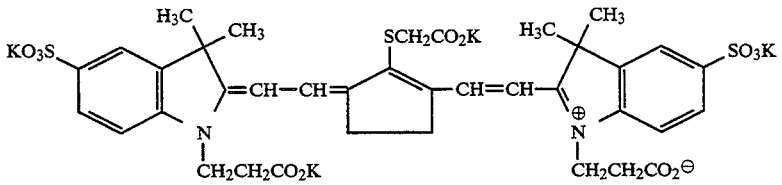
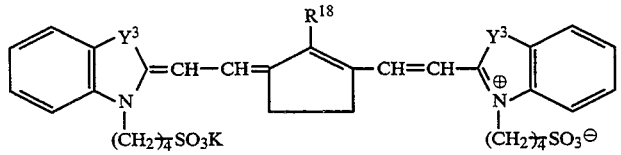
| Compound No. | $Y^3$ | $R^{18}$ |
|---|---|---|
| (46) | —S— | $-SCH_2CO_2K$ |
| (47) | —Te— | —O— 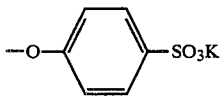 |
| (48) | —Se— | —S— 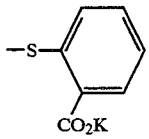 |
| (47) | —O— | $-SCH_2CO_2K$ |
| (50) | $-\overset{CH_3}{\overset{\vert}{N}}-$ | —O— 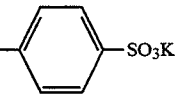 |
Compound (51)

-continued
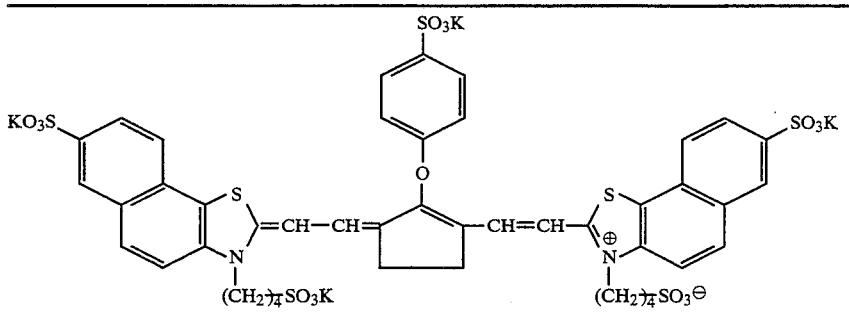
Compound (52)
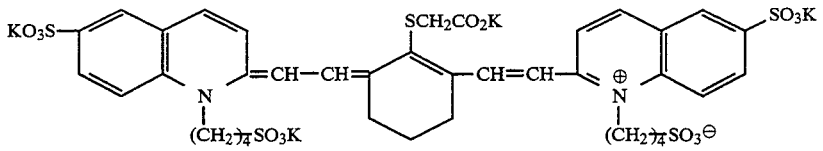
Compound (53)
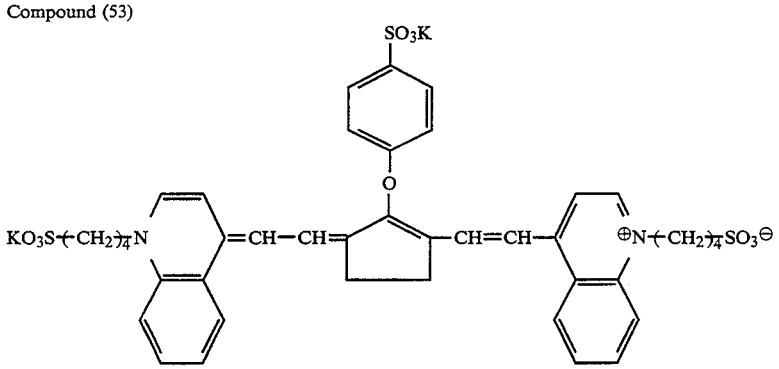
Compound (54)
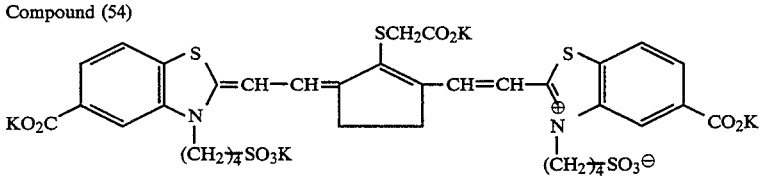
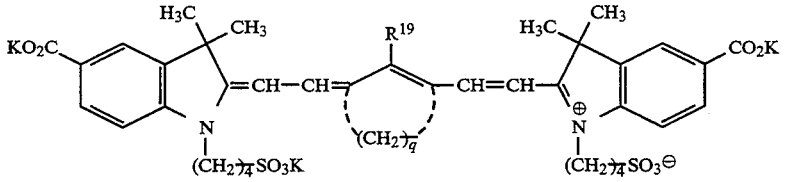
| Compound No. | $R^{19}$ | q |
|---|---|---|
| (55) | $-SCH_2CO_2K$ | 2 |
| (56) | $-SCH_2CH_2CO_2K$ | 2 |
| (57) | $-SCH(CH_2CO_2K)-CO_2K$ | 2 |
| (58) | $-SCH_2CH_2SO_3K$ | 3 |
| (59) | 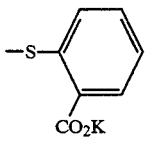 | 3 |
| (60) | $-SCH_2CO_2K$ | 3 |

Examples of the synthesis of the dye of the present invention are given below.

(Synthesis of Compound (1) of the present invention)

3 g of Dye Compound (16) disclosed in EP-A-0430244 (corresponding to JP-A-3-171136) was dissolved in 15 ml of water. To the solution were added 0.8 ml of triethylamine and 0.33 g of thioglycolic acid. The reaction mixture was then stirred at room temperature for 1 hour. After the completion of the reaction, the reaction product was filtered off, and then recrystallized from a mixture of methyl alcohol and potassium acetate.

Yield: 0.9 g

λmax: 813.7 nm ($H_2O$)

ε: $1.74\times10^5$

Dye Compound (16) disclosed in EP-A-0430244:

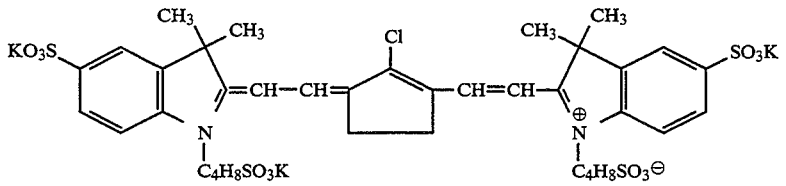

(Synthesis of Compound (20) of the present invention)

1.3 g of Compound (20) was prepared in the same manner as mentioned above from 2 g of Dye Compound (16) disclosed in EP-A-0430244 (corresponding to JP-A-3-171136).

λmax: 782.0 nm ($H_2O$)

ε: $2.01\times10^5$

Other dyes can be similarly synthesized.

The dyes of formulae (I), (II) and (III) are incorporated preferably in a light-sensitive or light-insensitive hydrophilic colloidal layer coating solution in the form of a solution in an appropriate solvent (e.g., water, alcohol such as methanol and ethanol, methyl cellosolve, mixture thereof) or in the form of an aqueous decomposition product. Two or more of these dyes may be used in combination.

The preferred amount of the foregoing dye to be used is generally from $10^3$ g/m$^2$ to 2.5 g/m$^2$, preferably $10^3$ g/m$^2$ to 1.0 g/m$^2$, of photographic material.

The photographic dyes of formulae (I), (II) and (III) are effective for the purpose of inhibiting irradiation. If used for this purpose, these dyes are mainly incorporated in the emulsion layer.

The photographic dyes of formulae (I), (II) and (III) are also effective for the purpose of inhibiting halation. If used for this purpose, these dyes are incorporated in the side of the support or between the support and the emulsion layer.

The photographic dyes of formulae (I), (II) and (III) can also be advantageously used as filter dyes.

In the present invention, the dyes represented by formulae (I), (II) and (III) are preferably used in combination with a binder.

Examples of hydrophilic colloidal materials to be used as binders include gelatin, substitute for gelatin, collodion, gum arabic, cellulose ester derivatives such as alkylester of carboxylated cellulose, hydroxyethyl cellulose and carboxymethylhydroxyethyl cellulose, synthetic resins such as amphoteric polymers disclosed in U.S. Pat. No. 2,949,442, polyvinyl alcohol, and other materials known to those skilled in the art.

Examples of alternative high molecular gelatins include a copolymer of acrylamine and methacrylic acid, a copolymer of allylamine and acrylic acid, a hydrolyzable copolymer of allylamine, methacrylic acid and vinyl acetate, a copolymer of allylamine, acrylic acid and styrene, and a copolymer of allylamine, methacrylic acid and acrylonitrile.

The photographic light-sensitive material of the present invention may be in the form of a black-and-white photographic light-sensitive material as well as a color photographic light-sensitive material.

The specific constitution of the present invention will be further described hereinafter.

The halogen composition of the silver halide emulsion to be used in the present invention may be any of silver bromide, silver bromochloride, silver bromochloroiodide, and the like, provided that the silver chloride content is not more than 50 mol %. Preferably, it is a silver bromochloride having a silver chloride content of 50 mol % or less, preferably from 5 mol % to 40 mol %.

This is because the fixability of the photographic light-sensitive material can be raised by increasing the silver chloride content, but the increase in the silver chloride content causes a sensitivity drop, as described in Japanese Patent Application No. 3-266934.

The silver halide grains to be used in the present invention are preferably finely divided (e.g., preferably 0.7 μm or less, more preferably 0.5 μm or less)

The silver halide grains to be used in the present invention may be any of a cube, octahedron, tetradecahedron, tablet and sphere or mixture thereof, preferably cube, tetradecahedron or tablet.

The preparation of silver halide grains to be used in the present invention can be accomplished by any suitable method disclosed in P. Glafkides, *Chimie et Physique Photographique* (published by Paul Montel, 1967), G. F. Duffin, *Photographic Emulsion Chemistry* (published by The Focal Press, 1966), and V. L. Zelikman et al., *Making and Coating Photographic Emulsion*, (published by The Focal Press, 1964).

The emulsion can be prepared by any of the acid process, the neutral process, the ammonia process, etc. The reaction between a soluble silver salt and a soluble halogen salt can be carried out by any of a single jet process, a double jet process, a combination thereof, and the like.

A method in which grains are formed in the presence of excess silver ions (so-called reverse mixing method) may be used. Further, a so-called controlled double jet process, in which the pAg value of a liquid phase in which silver halide grains are formed is maintained constant, may also be used.

According to the controlled double jet process, a silver halide emulsion having a regular crystal form and an almost uniform grain size can be obtained.

In order to provide a uniform grain size, a method which comprises changing the rate at which a silver nitrate for halogenated alkali is added depending on the growth speed of grains as disclosed in British Patent 1,535,016, and JP-B-48-36890 and JP-B-52-16364 or a method which comprises changing the concentration of an aqueous solution as disclosed in British Patent 4,242,445, and JP-A-55-158124 may be used to allow grains to grow rapidly within the critical saturation degree.

The silver halide grains to be used in the present invention may have a so-called core/shell structure having a halogen composition differing from the inner portion to the surface layer.

The formation of the silver halide emulsion of the present invention may be carried out in the presence of a silver halide solvent such as tetra-substituted thiourea and organic thioether compound.

Preferred examples of tetra-substituted thiourea silver halide solvents which can be used in the present invention include those described in JP-A-53-82408 and JP-A-55-77737.

Examples of organic thioether silver halide solvents which may preferably be used in the present invention include a compound containing at least one group, wherein an oxygen atom and a sulfur atom are separated by an ethylene group (e.g., —O—$CH_2CH_2$—S—) as disclosed in U.S. Pat. No. 3,574,628 (JP-B-47-11386), and a chain thioether compound containing an alkyl group (the alkyl group contains at least two substituents selected from hydroxyl group, amino group, carboxyl group, amide group and sulfon group) at both ends as disclosed in JP-A-54-155828 (U.S. Pat. No. 4,276,374).

The amount of silver halide solvent to be incorporated in the system depends on the kind of compounds used and the desired grain size and halogen composition and is preferably from $10^{-5}$ to $10^{-2}$ mol per mol of silver halide.

If the grain size exceeds the desired value due to the use of a silver halide solvent, the desired grain size can be obtained by (1) altering the temperature at which the grains are formed, (2) changing the time at which a silver salt solution, and (3) adding a halogen salt solution to the system, and other factors.

In the present invention, a water-soluble iridium compound can be used. Examples of such a water-soluble iridium compound include a halogenated iridium (III) compound, a halogenated iridium (IV) compound, and an iridium complex salt having a halogen, amine, oxalate or the like as a ligand (e.g., hexachloroiridium (III) or (IV) complex salt, hexamineiridium (III) or (IV) complex salt and trioxalate iridium (III) or (IV) complex salt). In the present invention, any trivalent compound and tetravalent compound among these compounds may be used in combination.

These iridium compounds may be used in the form of a solution in water or other appropriate solvent. In order to stabilize the iridium compound solution, a commonly used method, i.e., a method which comprises the addition of an aqueous solution of hydrogen halide (e.g., hydrochloric acid, bromic acid, fluoric acid) or alkali halide (e.g., KCl, NaCl, KBr, NaBr) may be used. Instead of using such a water-soluble iridium, silver halide grains which have been previously doped with iridium may be added to and dissolved in the system during the preparation of the silver halide grains of the present invention.

The total amount of iridium compounds of the present invention to be incorporated in the system is $10^{-8}$ mol or more, preferably $1\times10^{-8}$ to $1\times10^{-5}$ mol, most preferably $5\times10^{-8}$ to $5\times10^{-6}$ mol per mol of eventually produced silver halide.

The addition of these compounds to the system may be properly effected at any step during the preparation of the silver halide emulsion and before the coating of the emulsion. In particular, these compounds are preferably added to the system during the formation of silver halide grains so that these compounds are incorporated in the silver halide grains. Further, a compound containing the group VIII atoms other than iridium and an iridium compound may be used in combination.

The silver halide photographic emulsion of the present invention may be chemically sensitized with a gold compound (hereinafter referred to as "gold-sensitized") to attain high sensitivity and low photographic fog. The gold sensitization may be normally effected by stirring the emulsion with s gold sensitizer at a temperature of 40° C. or higher for a predetermined period of time.

As the gold sensitizer for the foregoind gold sensitization a gold compound commonly used as a gold sensitizer may be used. The oxidation number of such a gold sensitizer may be either +1 or +3. Typical examples of such a gold sensitizer include chloroauric acid, potassium chloroaurate, auric trichloride, potassium auric thiocyanate, potassium iodoaurate, tetracyanoauric acid, ammonium aurothiocyanate, and pyridyltrichlorogold.

The amount of such a gold sensitizer to be added depends on the various conditions but is generally from $1\times10^{-7}$ mol to $5\times10^{-4}$ mol per mol of silver halide.

The silver halide photographic emulsion of the present invention may be subjected to chemical sensitization in combination with sulfur sensitization to further attain a high sensitivity and a low photographic fog.

The sulfur sensitization may be normally effected by stirring the emulsion with a sulfur sensitizer at a temperature of 40° C. or higher for a predetermined period of time.

A known compound may be used as a sulfur sensitizer. Examples of such a sulfur sensitizer include thiosulfate, thiourea, allylisothiocyanate, cystine, p-toluenethiosulfonate, and rhodanine. Besides these compounds, sulfur sensitizers disclosed in U.S. Pat. Nos. 1,574,944, 2,410,689, 2,278,947, 2,728,668, 3,501,313, and 3,656,955, German Patent 1,422,869, JP-B-56-24937 (The term "JP-B" as used herein means an "examined Japanese patent publication"), and JP-A-55-45016 can be used. The amount of the sulfur sensitizer to be added only needs to be large enough to effectively increase the sensitivity of the emulsion. It greatly depends on various conditions such as pH, temperature and size of silver halide grains but is preferably from $1\times10^{-7}$ mol to $5\times10^{-4}$ mol per mol of silver halide.

For the chemical ripening, it is not necessary to limit the time and order of the addition of sulfur sensitizer and gold sensitizer. For example, these compounds may be added simultaneously or at different times during the initial period of the chemical ripening (preferably) or during the progress of the chemical ripening. These compounds may be added to the system in the form of solution in water or an organic solvent miscible with water, such as methanol, ethanol and acetone, singly or in admixture.

When sulfur sensitization with a thiosulfate, selenium sensitization with a selenium compound, and gold sensitization are effected in combination, the effects of the present invention can be effectively attained.

The chemical sensitizer which can be effectively used in the present invention may be a selenium compound as disclosed in the prior art patents. An unstable selenium compound and/or stable selenium compound may be added to the system which is then stirred at a temperature of 40° C. or higher for a predetermined period of time.

A preferred unstable selenium compound is a compound disclosed in JP-B-41-15748, and JP-B-43-13489, JP-A-4-25832, and JP-A-4-109240. Specific examples of such an unstable selenium compound include isoselenocyanates (e.g., aliphatic isoselenocyanates such as allylisoselenocyanate), selenoureas, selenoketones, selenoamides, selenocarboxylic acids (e.g., 2-selenopropionic acid, 2-selenobutyric acid), selenoesters, diacylselenides (e.g., bis(3-chloro-2,6-dimethoxybenzoyl)selenide), selenophosphates, phosphineselenides, and colloidal metallic selenium.

Preferred examples of unstable selenium compounds have been given above, but these examples are not restrictive. For the unstable selenium compound which serves as a sensitizer for photographic emulsion, its structure is not particularly important to those skilled in the art, provided that it is unstable. It is generally understood that the organic moiety of the selenium sensitizer molecule only serves to carry selenium and allow it to occur in the emulsion in an unstable form. In the present invention, unstable selenium compounds having such a wide function can be advantageously used.

The stable selenium compound to be used in the present invention may be a compound disclosed in JP-B-46-4553, JP-B-52-34492, and JP-B-52-34491. Examples of such a stable selenium compound include selenious acid, potassium selenocyanide, selenazoles, quaternary salts of selenazoles, diaryl selenide, diaryl diselenide, dialkyl selenide, dialkyl diselenide, 2-selenazolidine dione, 2-selenoxazolidine thione, and derivatives thereof.

The sensitizing dye sensitive to 600 nm or higher which may preferably be used exhibits an optimum spectral sensitivity to He-Ne laser or semiconductor laser. Such sensitizing dyes preferably include a sensitizing dye disclosed in JP-A-3-15049, page 12, upper left column to page 21, lower left column; JP-A-3-20730, page 4, lower left column to page 15, lower left column; EP-A-420011, page 4, line 21 to page 6, line 54; EP-A-420012, page 4, line 12 to page 10, line 33; EP-A-443466; U.S. Pat. No. 4,975,362; JP-A-2-157749, pp. 13–38; JP-A-3-171136, pp. 8–12; and JP-A-62-215272, pp. 22–38. Particularly preferred among these sensitizing dyes are dyes represented by formulae [I], [II] and [III] disclosed in JP-A-3-171136, pp. 8–12. However, if used singly, these sensitizing dyes cannot provide a sufficient spectral sensitizing efficiency. As the amount of such a sensitizing dye to be used is increased, the inherent desensitization tends to decrease. In order to cope with this difficulty, a supersensitizing agent may be used in combination with these sensitizing dyes as is well known in the art. Such a supersensitizing agent is disclosed in JP-B-60-45414, and JP-B-46-10473, and JP-A-59-192242.

These sensitizing dyes may be used singly or in combination. Such a combination of sensitizing dyes is often used for the purpose of supersensitization. In combination with such a sensitizing dye, a dye which does not exhibit a spectral sensitizing effect itself or a substance which does not substantially absorb visible light and exhibits a supersensitizing effect may be incorporated in the emulsion.

Examples of useful sensitizing dyes, combination of supersensitizing dyes and supersensitizing substances are described in *Research Disclosure* No. 17643, vol. 176 (December 1978), JP-B-49-25500, JP-B-43-4933, JP-A-59-19032, and JP-A-59-192242.

The optimum content of the sensitizing dye of the present invention having an absorption in the wavelength range of 600 nm or more may preferably be selected depending on the grain diameter, halogen composition and method and extent of chemical sensitization of silver halide emulsion, the relationship between the layer in which the compound of the present invention is incorporated and the silver halide emulsion, the kind of fog inhibiting compound used, etc. The testing method for the selection of the optimum value is well known by those skilled in the art. In general, the sensitizing dye of the present invention may preferably be used in amount an of $10^{-7}$ to $1\times10^{-2}$ mol, more preferably $10^{-6}$ to $5\times10^{-3}$ mol, per mol of silver halide.

Supersensitizing agents which may be used include compounds disclosed in JP-A-3-15049, pp. 22–25, and JP-A-62-123454, pp. 15–20.

The light-sensitive material of the present invention may comprise various compounds for the purpose of inhibiting fogging during the preparation, storage or photographic processing of light-sensitive material or stabilizing photographic properties. In particular, many compounds known as fog inhibitors or stabilizers can be used. Examples of these fog inhibitors or stabilizers include azoles such as benzothiazolium salt, nitroindazoles, chlorobenzimidazoles, bromobenzimidazoles, mercaptothiazoles, mercaptobenzothiazoles, mercaptothiadiazoles, aminotriazoles, benzothiazoles, nitrobenzotriazoles, mercaptopyrimidines, mercaptotriazoles, thioketo compounds such as oxazolinethione, azaindenes such as triazaindenes, tetrazaindenes (particularly 4-hydroxy-substituted (1,3,3a,7)tetrazaindenes), and pentaazaindenes, benzenethiosulfonic acid, benzenesulfinic acid, and benzenesulfonic amide.

In particular, polyhydroxybenzene compounds may preferably be used to improve pressure resistance without impairing sensitivity. These polyhydroxybenzene compounds are preferably compounds having any of the following structures:

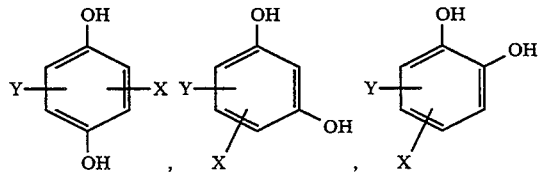

wherein X and Y each represents —H, —OH, a halogen atom, —OM (in which M represents an alkaline metal ion), an alkyl group, a phenyl group, an amino group, a carbonyl group, a sulfone group, a sulfonated phenyl group, a sulfonated alkyl group, a sulfonated amino group, a sulfonated carbonyl group, a carboxyphenyl group, a carboxyalkyl group, a carboxyamino group, a hydroxyphenyl group, a hydroxyalkyl group, an alkylether group, an alkylphenyl group, an alkylthioether group, or a phenylthioether group, preferably —H, —OH, —Cl, —Br, —COOH, $—CH_2CH_2COOH$, $—CH_3$, $—CH_2CH_3$, $—CH(CH_3)_2$, $—C(CH_3)_3$, $—OCH_3$, —CHO, $—SO_3Na$, $—SO_3H$, $—SCH_3$,

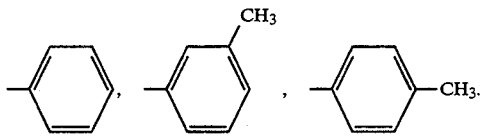

X and Y may be the same or different.

The polyhydroxybenzene compound may be incorporated in the emulsion layer or other layers in the photographic light-sensitive material. The effective amount of the polyhydroxybenzene compound to be incorporated is from $10^{-5}$ mol to 1 mol, more preferably from $10^{-3}$ mol to $10^{-1}$ mol.

The photographic light-sensitive material prepared according to the present invention may comprise a water-soluble dye incorporated in the hydrophilic colloidal layer as a filter dye or for the purpose of inhibiting irradiation or other various purposes. Examples of such a water-soluble dye include an oxonol dye, a hemioxonol dye, a styryl dye, a melocyanine dye, a cyanine dye, and an azo dye. Particularly useful among these water-soluble dyes are an oxonol dye, a hemioxonol dye, a cyanine dye, and a melocyanine dye.

The photographic light-sensitive material of the present invention may comprise a developing agent such as polyalkylene oxide or ether, ester or amine derivative thereof, thioether compound, thiomorpholines, quaternary ammonium salts, urethane derivatives, urea derivatives, imidazole derivatives, 3-pyrazolidones and aminophenols incorporated in the photographic emulsion layer for the purpose of enhancing the sensitivity or contrast or accelerating development.

In particular, 3-pyrazolidones (e.g., 1-phenyl-3-pyrazolidone, 1-phenyl-4-methyl-4-hydroxymethyl-3-pyrazolidone) are preferred. Such a developing agent is normally used in an amount of 5 g/m$^2$ or less, preferably from 0.01 g/m$^2$ to 0.2 g/m$^2$.

The photographic emulsion and light-insensitive hydrophilic colloid of the present invention may contain an inorganic or organic film hardener. For example, activated vinyl compounds (e.g., 1,3,5-triacryloyl-hexahydro-s-triazine, bis(vinylsulfonyl)methylether, N,N-methylenebis-[$\beta$-(vinylsulfonyl)propionamide]), activated halogen compounds (e.g., 2,4-dichloro-6-hydroxy-s-triazine), mucohalogenic acids (e.g., mucochloric acid), N-carbamoylpyridinium salts (1-morpholino(carbonyl-3-pyridinio)methanesulfonate), and haloamidinium salts (1-(1-chloro-1-pyridinomethylene)-pyrrolidinium, 2-naphthalenesulfonate) may be used singly or in combination. In particular, activated vinyl compounds as disclosed in JP-A-53-41220, JP-A-53-57257, JP-A-59-162546, and JP-A-60-80846 and activated halides as disclosed in U.S. Pat. No. 3,325,287 are preferred.

The photographic emulsion layer or other hydrophilic colloidal layers in the light-sensitive material prepared according to the present invention may comprise various surface active agents for the purpose of facilitating coating, inhibiting electrification, emulsion dispersion and adhesion, and improving sliding properties and photographic properties (e.g., accelerating development, improving contrast, sensitization).

Examples of such surface active agents nonionic surface active agents such as saponin (steroid series), alkylene oxide derivatives (e.g., polyethylene glycol, polyethylene glycol/polypropylene glycol condensate, polyethylene glycol alkyl ether or polyethylene glycol alkylaryl ether, polyethylene glycol ester, polyethylene glycol sorbitan ester, polyalkylene glycol alkylamine or amide, polyethylene oxide addition product of silicone), glycidol derivatives (e.g., polyglyceride alkenylsuccinate, alkylphenol polyglyceride), aliphatic ester of polyvalent alcohol, or alkylester of saccharide; anionic surface active agents containing acid groups such as carboxyl group, sulfo group, phospho group, ester sulfate group or ester phosphate group (e.g., alkylcarboxylate, alkylsulfonate, alkylbenzenesulfonate, alkylnaphthalenesulfonate, alkylsulfuric ester, alkylphosphoric ester, N-acyl-N-alkyltaurine, sulfosuccinic ester, sulfoalkyl polyoxyethylenealkylphenylether, polyoxyethylenealkylphosphoric ester); amphoteric surface active agents such as amino acid salt, aminoalkylsulfonic acid, aminoalkylsufuric or phosphoric ester, alkylbetaine and amine oxide; and cationic surface active agents such as alkylamine salt, aliphatic or aromatic quaternary ammonium salt, heterocyclic quaternary ammonium salt (e.g., pyridinium, imidazolium), and aliphatic or heterocyclic group-containing phosphonium or sulfonium salt.

For the purpose of antistatic treatment, a fluorine-containing surface active agent disclosed in JP-A-60-80849 may preferably be used.

The photographic light-sensitive material of the present invention may comprise a matting agent such as silica, magnesium oxide and polymethyl methacrylate in the photographic emulsion layer or other hydrophilic colloidal layers for the purpose of inhibiting adhesion.

The light-sensitive material to be used in the present invention may comprise a water-insoluble or slightly water-soluble synthetic polymer dispersion for the purpose of stabilizing dimension. For example, alkyl (meth-)acrylate, alkoxyacryl (meth) acrylate, glycidyl (meth-)acrylate, and the like, may be used singly or in combination. Furthermore, a polymer comprising as a monomeric component a combination of these acrylic acids, methacrylic acids, and the like, may be used.

As a condensation agent or a protective colloid for the photographic emulsion gelatin may be advantageously used. Other hydrophilic colloids can also be used. For example, proteins such as gelatin derivative, graft polymer of gelatin and other high molecular compounds, albumin and casein; cellulose derivatives such as hydroxyethyl cellulose, carboxymethyl cellulose and cellulose sulfuric ester; saccharide derivatives such as sodium alginate and starch derivative; and various synthetic hydrophillic high molecular compounds such as single polymer and copolymer, e.g., polyvinyl alcohol, polyvinyl alcohol partial acetal, poly-N-vinyl pyrrolidone, polyacrylic acid, polymethacrylic acid, polyacrylamide, polyvinyl imidazole, and polyvinyl pyrazole.

As gelatin, a lime-treated gelatin as well as acid-treated gelatin, gelatin hydrolyzate and enzymatic decomposition product of gelatin can be used.

The silver halide emulsion layer to be used in the present invention may comprise a polymer latex such as alkyl acrylate.

The support for the photographic light-sensitive material of the present invention may be cellulose triacetate, cellulose diacetate, nitrocellulose, polystyrene, polyethylene terepthalate paper, baryta-coated paper, polyolefin-coated paper or the like.

The developing agent to be incorporated in the developer of the present invention preferably contains dihydroxybenzenes or 3-pyrazolidones, more preferably hydroquinone, 1-phenyl-3-pyrazolidone or 1-phenyl-4-methyl-4-hydroxymethyl-3-pyrazolidone, to provide high sensitivity.

Examples of sulfites which can be used as preservatives in the present invention include sodium sulfite, potassium sulfite, lithium sulfite, ammonium sulfite, sodium bisulfite, potassium metabisulfite, and sodium formaldehydebisulfite. Such a sulfite can preferably be used in an amount of 0.25 mol/l or more, more preferably 0.4 mol/l or more. The upper limit of the amount of such a sulfite to be used is preferably 2.5 mol/l, more preferably 1.2 mol/l.

Examples of alkaline agents used to adjust a pH value include pH adjustors or buffers such as sodium hydroxide, potassium hydroxide and sodium carbonate.

Other additives can include development inhibitors such as boric acid, borax, sodium bromide, potassium bromide and potassium iodide; organic solvents such as ethylene glycol, diethylene glycol, triethylene glycol, dimethylformamide, methyl cellosolve, hexylene glycol, ethanol and methanol; and fog inhibitors or black pepper inhibitors such as mercapto compounds (e.g., 1-phenyl-5-mercaptotetrazole, sodium 2-mercaptobenzimidazole-5-sulfonate ), indazole compounds (e.g., 5-nitroindazole), and benztriazole compounds (e.g., 5-methylbenztriazole). There can be further contained color toners, surface active agents, antifoaming agents, film hardeners, and amino compounds disclosed in JP-A-56-106244 and JP-A-61-267759 and JP-A-2-208652.

The developer of the present invention may comprise a compound disclosed in JP-A-56-24347 as a silver stain inhibitor, a compound disclosed in JP-A-62-212651 as an uneven development inhibitor, and a compound disclosed in JP-A-61-267759 as a dissolution aid.

The developer to be used in the present invention may comprise boric acid disclosed in JP-A-62-186259 or saccharides (e.g., saccharose), oxims (e.g., acetoxim) or phenols (e.g., 5-sulfosalicylic acid) disclosed in JP-A-60-93433 as buffer.

The processing method of the present invention may be effected in the presence of a polyalkylene oxide. In order to incorporate such a polyalkylene oxide in the developer, a polyethylene glycol having a mean molecular weight of 1,000 to 6,000 may preferably be used in an amount of 0.1 g/l to 10 g/l.

The fixing solution may contain a water-soluble aluminum compound as a film hardener in addition to a fixing agent. Further, the fixing solution may optionally contain an acidic aqueous solution containing acetic acid and a dibasic acid (e.g., tartaric acid, citric acid, a salt thereof), preferably having a pH value of 3.8 or more, more preferably from 4.0 to6.5.

As the fixing agent, sodium thiosulfate, ammonium thiosulfate or the like may be used. In order to improve fixing speed, ammonium thiosulfate is particularly preferred. The amount of the fixing agent to be used can be properly altered but is normally from 0.1 mol/l to 5 mol/l.

The water-soluble aluminum salt which serves mainly as a film hardener in the fixing solution is a compound known as a film hardener for acidic film-hardening fixing solution, such as aluminum chloride, aluminum sulfate and potassium alum.

As the dibasic acid, tartaric acid, citric acid or a derivative thereof, can be used singly or in combination. Such a compound may be effectively incorporated in an amount of 0.005 mol or more, preferably 0.01 mol to 0.03 mol, per l of fixing solution.

Specific examples of such a dibasic acid include tartaric acid, potassium tartrate, sodium tartrate, sodium potassium tartrate, ammonium tartrate, and potassium ammonium tartrate.

Examples of useful citric acid or derivatives thereof in the present invention include citric acid, sodium citrate, and potassium citrate.

The fixing solution may optionally further contain a preservative (e.g., sulfite, bisulfite), a pH buffer (e.g., acetic acid, boric acid), a pH adjustor (e.g., ammonia, sulfuric acid), an image preservability improver (e.g., potassium iodide), and a chelating agent. The pH buffer may be used in an amount of 10 g/l to 40 g/l, preferably 18 g/l to 25 g/l because the pH value of the developer is high.

The washing water may contain a mildewproofing agent (e.g., compound as disclosed in Horiguchi, *Bokin Bobai no Kagaku* (*Chemistry of Sterilization and Mildewproofing*), and JP-A-62-115154), a washing accelerator (e.g., sulfite), a chelating agent, and the like.

In accordance with the foregoing process, the photographic light-sensitive material which has been developed and fixed is then rinsed and dried. The rinsing is effected to remove substantially all of silver salts which have been dissolved by fixing. The rinsing is preferably effected at a temperature of 20° C. to 50° C. for 10 seconds to 3 minutes. The drying is effected at a temperature of 40° C. to 100° C. The drying time can be properly altered by the ambient conditions but is normally from 5 seconds to 3.5 minutes.

A roller conveyor type automatic developing machine as described in U.S. Pat. Nos. 3,025,779 and 3,545,971 may be used to develop in the present invention. It is referred to as "roller conveyor type processor" herein. The roller conveyor type processor consists of four zones, i.e., development, fixing, rinsing and drying. The process used with the present invention does not exclude other procedures (e.g., stop) but most preferably follows the four procedures.

The replenishment rate of the rinsing water may be 1,200 ml/m$^2$ or less (including 0 ml/m$^2$).

The case where the replenishment rate of the rinsing water (or stabilizing solution) is 0 ml/m$^2$ means a so-called reservoir rinsing process. As an approach for reducing the replenishment rate, there has long been known a multi-stage countercurrent process (e.g., 2-stage, 3-stage).

In order to cope with problems caused when the replenishment rate of the rinsing water is small, the following approaches can be combined to provide excellent processing properties.

The rinsing bath or stabilizing bath may further contain an isothiazoline compound disclosed in R. T. Kreiman, *J. Image. Tech.*, vol. 10, No. 6, page 242 (1984), *Research Disclosure*, vol. 205, No. 20526 (May, 1981) and Ibid, vol. 228, No. 22845 (April, 1983) or a compound disclosed in JP-A-61-115154 and JP-A-62-209532 as a microbiocide. Moreover, the rinsing bath or stabilizing bath may contain compounds disclosed in Hiroshi Horiguchi, *Bokin Bobai no Kagaku* (*Chemistry of Sterilization and Mildewproofing*), Sankyo Shuppan, 1982, *Bokin Bobai Gijutsu Handbook* (*Handbook of Sterilization and Mildewproofing Techniques*), Nihon Bokin Bobai Gakkai, (Hakuhodo, 1986), L. E. West, "Water Quality Criteria", *Photo Sci & Eng.*, vol 9, No. 6 (1965), M. W. Beach, "Microbiological Growths in Motion Picture Processing", *SMPTE Journal*, vol. 85 (1976), and R. O. Deegan, "Photo Processing Wash Water Biocides", *J. Imaging Tech.*, vol. 10, No. 6 (1984).

In the process used with the present invention, if rinsing is conducted with a small amount of water, a washing tank with a squeeze roller or crossover roller as disclosed in JP-A-63-18350 and JP-A-62-287252 is preferably provided.

Further, the overflow solution from the washing tank or stabilizing tank caused by the replenishment of mildewproofing water into the washing tank or stabilizing tank depending on the processing according to the present invention may be entirely or partially reused for a processing solution having a fixing capacity as its preceding processing step as described in JP-A-60-235133 and JP-A-63-129343. In order to inhibit uneven bubbling, which is readily caused when the rinse is effected with a small amount of water and/or inhibit the transfer of the processing components attached to the squeeze roller to the processed film, a water-soluble surface active agent or anti-foaming agent may be added.

In order to inhibit the stain with a dye eluted from the photographic light-sensitive material, a dye adsorbent described in JP-A-63-163456 may be provided in the washing tank.

The photographic light-sensitive material of the present invention can exhibit excellent adaptability to rapid processing by an automatic developing machine for a total processing time of from 15 seconds to 60 seconds.

In the rapid development process used with the present invention, the development and fixing temperature and time are from 25° C. to 50° C. and 25 seconds or less, preferably from 30° C. to 40° C. and from 4 seconds to 15 seconds, respectively.

In the present invention, the photographic light-sensitive material which has been developed and fixed is then subjected to rinsing or stabilization. The rinsing may be effected in a 2-stage or 3-stage countercurrent rinsing process to save water. If the rinsing is effected with a small amount of washing water, a squeeze roller washing tank is preferably provided. The overflow liquid from the rinsing bath or stabilizing bath may be partially or entirely re-used as a fixing solution as described in JP-A-60-235133. This advantageously reduces the amount of waste liquid.

In the present invention, the photographic light-sensitive material which has been developed, fixed and rinsed is then dried through a squeeze roller. The drying is effected at a temperature of 40° C. to 80° C. for 4 seconds to 30 seconds.

The "total processing time" as defined herein means a total time elapsed between the point at which the tip of the film enters the inlet of the automatic developing machine and the point at which it leaves the outlet of a drying zone via a developing bath, a connecting zone, a fixing bath, a connecting zone, a rinsing bath, and a connecting zone.

The silver halide photographic material of the present invention can comprise a reduced amount of a gelatin as a binder in the emulsion layer and protective layer without causing pressure fog and thus can be developed without lowering developing speed, fixing speed and drying speed even in a rapid processing with a total processing time of 15 seconds to 60 seconds.

If the photographic light-sensitive material of the present invention is a color photographic light-sensitive material, it may preferably comprise cyan, magenta and yellow couplers disclosed in JP-A-2-285345, pp. 100–129. For coupler dispersants and coupler dispersion methods, reference can be made to JP-A-2-285345, pp. 129–132. For the processing of the color photographic light-sensitive material, reference can be made to JP-A-2-285345, from page 144, line 8 to page 168, line 11. For the scanning exposure light source, reference can be made to JP-A-2-285345, page 168, line 12 to page 170, line 9. For the layer configuration of the color photographic light-sensitive material, reference can be made to JP-A-2-285345, page 171, line 1 to page 172.

The present invention will be further described in the following examples, but the present invention should not be construed as being limited thereto.

In the following examples, amounts are by weight unless otherwise indicated.

EXAMPLE 1

1. Preparation of silver halide emulsion 34 g of gelatin was dissolved in 850 ml of water and kept at a temperature of 65° C. To the solution were then added 1.7 g of sodium chloride, 0.1 g of potassium bromide, and 70 mg of the following compound (A) as a silver halide solvent:

$$HO—(CH_2)_2—S—(CH_2)_2—S—(CH_2)_2—OH \quad (A)$$

To the solution were then added 500 ml of an aqueous solution containing 170 g of silver nitrate and 500 ml of an aqueous solution containing potassium hexachloroiridiumate (III) in such an amount that the molar ratio of iridium to produced silver halide is $5\times10^{-7}$, 12 g Of sodium chloride and 98 g of potassium bromide by a double jet process to prepare a monodisperse emulsion of cubic silver bromochloride grains having a mean grain size of 0.35 μm. The emulsion was then desalted. 50 g of gelatin was then added to the emulsion. The pH value and pAg value of the emulsion were then adjusted to 6.5 and 8.1, respectively. The emulsion was then subjected to chemical sensitization with 2.5 mg of sodium thiosulfate and 5 mg of chloroauric acid at a temperature of 65° C. To the emulsion was then added 0.2 g of 4-hydroxy-6-methyl-1,3,3a,7-tetrazaindene. The emulsion was then rapidly cooled and solidified (Emulsion A).

A monodisperse emulsion of cubic silver bromochloride grains having a mean grain size of 0.3 μm was prepared in the same manner as Emulsion A except that the gelatin solution was heated to a temperature of 40° C. The emulsion thus obtained was then desalted. To the emulsion was then added 50 g of gelatin. The pH value and pAg value of the emulsion were thus adjusted to 6.5 and 8.1, respectively. The emulsion was then subjected to chemical sensitization with 2.5 mg of sodium thiosulfate and 5 mg of chloroauric acid at a temperature of 65° C. To the emulsion was then added 0.2 g of 4-hydroxy-6-methyl-1,3,3a,7-tetrazaindene. The emulsion was then rapidly cooled and solidified to prepare Emulsion B.

2. Preparation of emulsion coating solution

Emulsion (A) and Emulsion (B) were mixed in a weight ratio of 1:1. To the mixture were then added the following additives (figure indicates amount added per mol of silver halide):

| (Formulation of emulsion coating solution) | |
|---|---|
| a. Spectral sensitizing dye [2] | $1.0\times10^{-4}$ mol |
| b. Supersensitizer [3] | $0.7\times10^{-3}$ mol |
| c. Preservability improver [4] | $1\times10^{-3}$ mol |
| d. Polyacrylamide (molecular amount: | 7.5 g |

-continued

| | |
|---|---|
| 40,000) | |
| e. Dextran | 7.5 g |
| f. Trimethylolpropan | 1.6 g |
| g. Sodium polystyrenesulfonate | 1.2 g |
| h. Latex of poly(ethyl acrylate/ methacrylic acid) | 12 g |
| i. N,N'-ethylenebis- (vinylsulfonacetamide) | 3.0 g |
| j. 1-Phenyl-5-mercapto-tetrazole | 50 mg |

Spectral sensitizing dye [2]

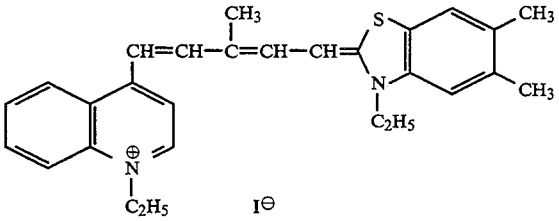

Supersensitizer [3]

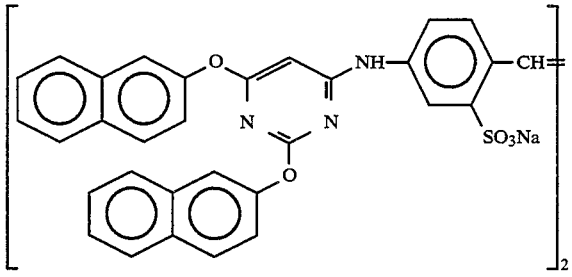

Preservability improver [4]

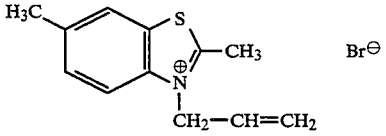

3. Preparation of coating solution for surface protective layer for emulsion layer A vessel was heated to a temperature of 40° C. Additives having the following formulations were then added to the system to prepare a coating solution.

(Formulation of coating solution for surface protective layer for emulsion layer)

| | |
|---|---|
| a. Gelatin | 100 g |
| b. Polyacrylamide (molecular weight: 40,000) | 12 g |
| c. Sodium polystyrenesulfonate (molecular weight: 600,000) | 0.6 g |
| d. N,N'-ethylenebis- (vinylsulfonacetamide) | 2.2 g |
| e. Finely divided polymethyl methacrylate grains (mean grain size: 2.0 μm) | 2.7 g |
| f. Sodium t-octylphenoxyethoxy- ethanesulfonate | 1.8 g |
| g. $C_{16}H_{33}O-(CH_2CH_2O)_{10}-H$ | 4.0 g |
| h. Sodium polyacrylate | 6.0 g |
| i. $C_8F_{17}SO_3K$ | 70 mg |
| j. $C_8F_{17}SO_2N(C_3H_7)(CH_2CH_2O)_4(CH_2)_4SO_3Na$ | 70 mg |
| k. NaOH(1N) | 6 ml |
| l. Methanol | 90 ml |
| m. Compound [5] | 0.06 g |

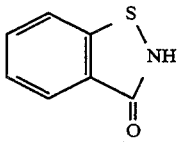

4. Preparation of coating solution for backing layer

A vessel was heated to a temperature of 40° C. Additives having the following formulations were then added to the System to prepare a coating solution for back layer.

(Formulation of coating solution for back layer)

| | |
|---|---|
| a. Gelatin | 100 g |
| b. Dye [A] | 4.2 g |
| c. Sodium polystyrenesulfonate | 1.2 g |
| d. Latex of poly(ethyl acrylate/methacrylic acid) | 5 g |
| e. N,N'-ethylenebis- (vinylsulfonacetamide) | 4.8 g |
| f. Compound [5] | 0.06 g |
| g. Dye [B] | 0.3 g |
| h. Dye [C] | 0.05 g |
| i. Colloidal silica | 15 g |

Dye [A]

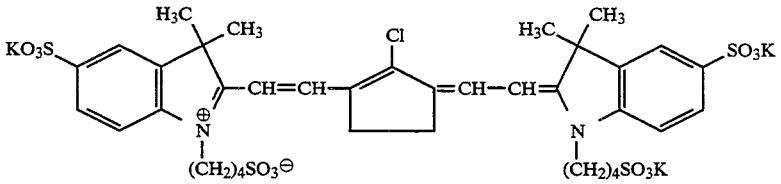

Dye [B]

-continued

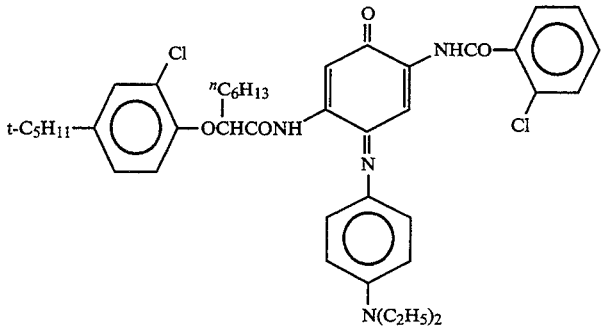

Dye [C]

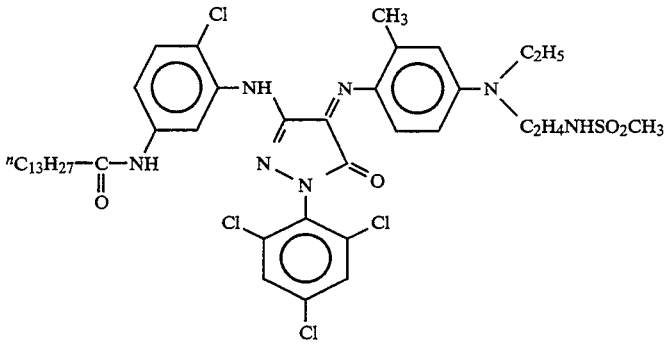

5. Preparation of coating solution for surface protective layer on back layer

A vessel was heated to a temperature of 40° C. Additives having the following formulations were then added to the system to prepare a coating solution.

(Formulation of coating solution for surface protective layer on back layer)

| | | |
|---|---|---|
| a. | Gelatin | 100 g |
| b. | Sodium polystyrenesulfonate | 0.5 g |
| c. | N,N'-ethylenebis-(vinylsulfonacetamide) | 1.9 g |
| d. | Finely divided polymethylmethacrylate grains (average grain size: 4.0 μm) | 4 g |
| e. | Sodium t-octylphenoxyethoxyethanesulfonate | 2.0 g |
| f. | NaOH (1N) | 6 ml |
| g. | Sodium polyacrylate | 2.4 g |
| h. | $C_{16}H_{33}O—(CH_2CH_2O)_{10}—H$ | 4.0 g |
| i. | $C_8F_{17}SO_3K$ | 70 mg |
| j. | $C_8F_{17}SO_2N(C_3H_7)(CH_2CH_2O)_4(CH_2)_4—SO_3Na$ | 70 mg |
| k. | Methanol | 150 ml |

-continued

| | | |
|---|---|---|
| l. | Compound [5] | 0.06 g |

6. Preparation of photographic light-sensitive material (Photographic Light-sensitive Material Specimen 1)

The aforementioned backing layer coating solution was coated on one side of a polyethylene terephthalate support along with the coating solution for surface protective layer for backing layer in such an amount that the total coated amount of gelatin reached 3.0 g/m$^2$. Subsequently, the aforementioned emulsion coating solution and surface protective layer coating solution were coated on the other side of the support in an amount such that the total coated amount of silver and the coated amount of gelatin in the surface protective layer reached 2.3 g/m$^2$ and 1.0 g/m$^2$, respectively.

Further, Photographic Light-sensitive Material Specimens 2 to 9 were prepared in the same manner as Specimen 1 except that Dye [A] was replaced by Comparative Dyes [D] and [E] and Dyes (1), (3), (4), (24), (34) and (58) of the present invention, respectively, in the same amount.

Dye [D]

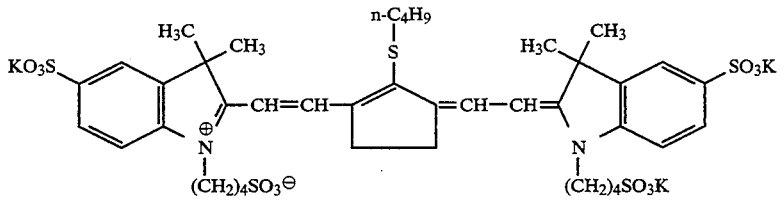

-continued

Dye [E]

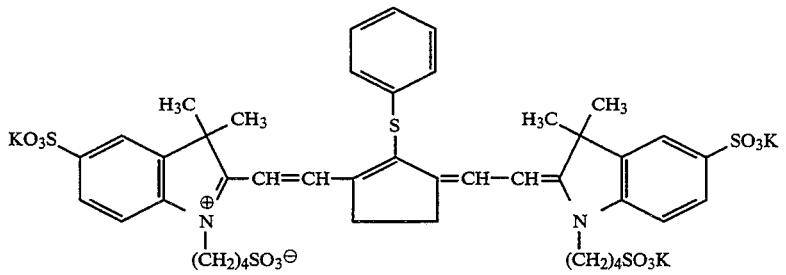

7. Evaluation of storage stability

The thus obtained photographic light-sensitive material specimens as set forth in Table 1 were allowed to stand at a temperature of 50° C. and a relative humidity of 70% for 5 days. These specimens were then measured for reflection spectrum from which the percentage absorbance change of each dye at the absorbance maxima wavelength (absorbance after storage at 50° C. and 70% RH/absorbance before storage at 50° C. and 70% RH) was determined. The results are set forth in Table 1.

8. Evaluation of decolorability

The photographic light-sensitive material specimens as set forth in Table 1 were processed for image formation and then measured for reflection spectrum on the white background. The absorbance at the absorption maxima before and after the image formation processing for each dye was compared to determine the percentage color remaining of the dye. The results are set forth in Table 1.

The photographic light-sensitive material specimens 1 to 9 were allowed to stand at a temperature of 25° C. and a relative humidity of 60% for 7 days after coating, subjected to scanning exposure by means of a 830 nm semiconductor laser at room temperature for $10^{-7}$ seconds, and then developed with the following developer [I] and fixing solution [I] by means of a roller conveyor type automatic developing machine. The development time was 7 seconds, the fixing time was 7 seconds, the rinsing time was 4 seconds, and the dehydration/drying time was 11 seconds. The conveying speed was 3,000 mm/min.

| Formulation of Developer [I] | |
|---|---|
| Potassium hydroxide | 29 g |
| Sodium sulfite | 31 g |
| Potassium sulfite | 44 g |
| Ethylenetriaminetetraacetic acid | 1.7 g |
| Boric acid | 1 g |
| Hydroquinone | 30 g |
| Diethylene glycol | 29 g |
| 1-Phenyl-3-pyrazolidone | 1.5 g |
| Glutaraldehyde | 4.9 g |
| 5-Methylbenzotriazole | 60 mg |
| 5-Nitroindazole | 0.25 g |
| Potassium bromide | 7.9 g |
| Acetic acid | 18 g |
| Water to make | 1,000 ml |
| pH | 10.3 |
| Formulation of Fixing Solution [I] | |
| Ammonium thiosulfate | 140 g |
| Sodium sulfite | 15 g |
| Disodium ethylenediaminetetraacetate dihydrate | 20 mg |
| Sodium hydroxide | 7 g |
| Aluminum sulfate | 10 g |
| Boric acid | 10 g |
| Sulfuric acid | 3.9 g |
| Acetic acid | 15 g |

-continued

| | |
|---|---|
| Water to make | 1,000 ml |
| pH | 4.30 |

The results are set forth in Table 1.

TABLE 1

| Photographic light-sensitive material | Dye | Dye remaining (%) | Color remaining (%) | Remarks |
|---|---|---|---|---|
| 1 | [A] | 65.0 | 2.8 | Comparison |
| 2 | [D] | 75.0 | 4.2 | Comparison |
| 3 | [E] | 76.0 | 5.3 | Comparison |
| 4 | (1) | 82.0 | 2.2 | Invention |
| 5 | (3) | 83.0 | 2.2 | Invention |
| 6 | (4) | 85.3 | 2.3 | Invention |
| 7 | (24) | 98.0 | 2.3 | Invention |
| 8 | (55) | 82.7 | 2.0 | Invention |
| 9 | (58) | 94.7 | 1.8 | Invention |

The results set forth in Table 1 show that the dyes of the present invention have excellent stability and exhibit little residual color.

Thus, it can be seen that the photographic light-sensitive material of the present invention exhibit an excellent storage stability as well as little color remaining after image formation processing.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a silver halide emulsion layer and a hydrophilic colloidal layer containing at least one dye represented by the following formula (III):

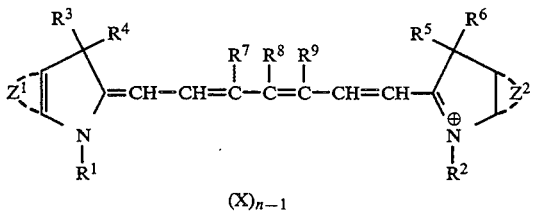

(III)

wherein $Z^1$ and $Z^2$ each represents a nonmetallic atom group necessary for forming a benzo condensed or naphtho condensed ring;

$R^1$, $R^2$, $R^3$, $R^4$, $R^5$ and $R^6$ each represents an alkyl group;

$R^7$ and $R^9$ each represents a hydrogen atom or a nonmetallic atom group necessary for forming a 5- or 6-membered ring by connecting to each other;

$R^8$ represents $—OR^{12}$, $—N(R^{12})(R^{13})$, or $—CH(R^{14})(R^{15})$; in which $R^{12}$ represents an alkyl or aryl group substituted by an acidic substituent, $R^{13}$ represents a hydrogen atom or an alkyl or aryl group substituted by an acidic substituent, and $R^{14}$ and $R^{15}$ each represents a cyano group, a carboxylic acid group, an acyl group, an alkoxycarbonyl group, an aryloxycarbonyl group, a carbamoyl group, a sulfonyl group or a sulfamoyl group, with the proviso that at least one of $R^{14}$ and $R^{15}$ contains an acidic substituent;

X represents an anion; and n represents an integer 1 or 2, with the proviso that when the dye forms an intramolecular salt, n is 1; and wherein the dye contains at least four acidic substituents.

2. A silver halide photographic material comprising a silver halide emulsion layer and a hydrophilic colloidal layer containing at least one dye represented by the following formula (III):

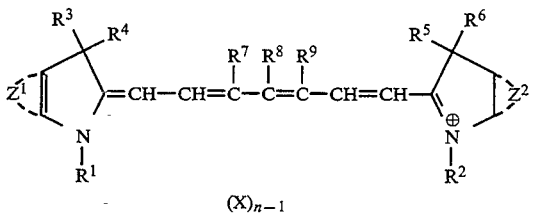

(III)

wherein $Z^1$ and $Z^2$ each represents a nonmetallic atom group necessary for forming a benzo condensed or naphtho condensed ring;

$R^1$, $R^2$, $R^3$, $R^4$, $R^5$ and $R^6$ each represents an alkyl group;

$R^7$ and $R^9$ each represents a hydrogen atom or a nonmetallic atom group necessary for forming a 5- or 6-membered ring by connecting to each other;

$R^8$ represents $—SR^{12}$ in which $R^{12}$ represents an alkyl group substituted by an acidic substituent;

X represents an anion; and n represents an integer 1 or 2, with the proviso that when the dye forms an intramolecular salt, n is 1; and wherein the dye contains at least four acidic substituents.

3. The silver halide photographic material as in claim 2, wherein $R^{12}$ represents an alkyl group substituted by a sulfonic acid or carboxylic acid group; and $R^7$ and $R^9$ are connected to each other to form a 5- or 6- membered ring.

* * * * *